US005949334A

United States Patent [19]

Lian et al.

[11] Patent Number: 5,949,334

[45] Date of Patent: Sep. 7, 1999

[54] MAGNETOSTRICTIVE ELEMENT HAVING OPTIMIZED BIAS-FIELD-DEPENDENT RESONANT FREQUENCY CHARACTERISTIC

[75] Inventors: Ming-Ren Lian, Boca Raton; Nen-Chin Liu, Parkland, both of Fla.; Kevin Coffey, Fremont, Calif.; Richard Copeland, Boca Raton; Wing Ho, Boynton Beach, both of Fla.; Robert C. O'Handley, Andover, Mass.

[73] Assignee: Sensormatic Electronics Corporation, Boca Raton, Fla.

[21] Appl. No.: 08/800,771

[22] Filed: Feb. 14, 1997

Related U.S. Application Data

[63] Continuation-in-part of application No. 08/538,026, Oct. 2, 1995, Pat. No. 5,684,459.

[51] Int. Cl.[6] ..... G08B 13/14

[52] U.S. Cl. ..... 340/572.1; 340/572.6; 148/108; 148/304; 148/DIG. 3; 266/110; 266/249

[58] Field of Search ..... 340/572, 551, 340/572.1, 572.6; 148/108, DIG. 3, 103, 304, 566; 266/110, 249, DIG. 95, DIG. 49, DIG. 25

[56] References Cited

U.S. PATENT DOCUMENTS

| | | | |
|---|---|---|---|
| 4,236,946 | 12/1980 | Aboaf et al. | 148/108 |
| 4,475,962 | 10/1984 | Hayakawa et al. | 148/108 |
| 4,510,489 | 4/1985 | Anderson, III et al. | 340/572 |
| 4,510,490 | 4/1985 | Anderson, III et al. | 340/572 |
| 4,622,543 | 11/1986 | Anderson et al. | 340/572 |
| 4,637,843 | 1/1987 | Takayama et al. | 420/73 |
| 4,686,516 | 8/1987 | Humphrey | 340/572 |
| 4,797,658 | 1/1989 | Humphrey | 340/551 |
| 5,154,983 | 10/1992 | Watanabe | 428/611 |
| 5,225,951 | 7/1993 | Kira et al. | 360/113 |
| 5,252,144 | 10/1993 | Martis | 148/121 |
| 5,310,975 | 5/1994 | Eklund et al. | 219/10.57 |
| 5,456,718 | 10/1995 | Szymaitis | 623/11 |
| 5,469,140 | 11/1995 | Liu et al. | 340/551 |
| 5,494,534 | 2/1996 | Leu | 148/108 |
| 5,495,231 | 2/1996 | Hasegawa | 340/551 |
| 5,514,229 | 5/1996 | Parkansky et al. | 148/566 |
| 5,539,380 | 7/1996 | Hasegawa et al. | 340/551 |
| 5,565,849 | 10/1996 | Ho et al. | 340/572 |
| 5,568,125 | 10/1996 | Liu et al. | 340/551 |
| 5,628,840 | 5/1997 | Hasegawa | 148/304 |
| 5,676,767 | 10/1997 | Liu et al. | 148/108 |
| 5,684,459 | 11/1997 | Liu et al. | 340/572 |

FOREIGN PATENT DOCUMENTS

| | | | |
|---|---|---|---|
| 9003652 | 4/1990 | WIPO | H01F 1/153 |

OTHER PUBLICATIONS

Livingston, "Magnetomechanical Properties of Amorphous Metals", *Phys. Stat. Sol.*, vol. 70, pp. 591–596, 1982.

O'Handley, "Magnetostriction of Ferromagnetic Metallic Glasses", *Solid State Communications*, vol. 21, pp. 1119–1122, 1977.

*Primary Examiner*—Nina Tong

*Attorney, Agent, or Firm*—Robin, Blecker & Daley

[57] ABSTRACT

A magnetostrictive element for use in a magnetomechanical marker has a resonant frequency characteristic that is at a minimum at a bias field level corresponding to the operating point of the magnetomechanical marker. The magnetostrictive element has a magnetomechanical coupling factor k in the range 0.28 to 0.4 at the operating point. The magnetostrictive element is formed by applying current-annealing to an iron-nickel-cobalt based amorphous metal ribbon, or by cross-field annealing an iron-nickel-cobalt alloy that includes a few percent chromium and/or niobium.

35 Claims, 10 Drawing Sheets

Amorphous $(Fe\text{-}Ni\text{-}Co)_{\sim 77}(Cr,Nb)_{0-8}(BSi)_{20-23}$

MAGNETOSTRICTIVE ELEMENT HAVING OPTIMIZED BIAS-FIELD-DEPENDENT RESONANT FREQUENCY CHARACTERISTIC

CROSS-REFERENCE TO RELATED APPLICATION

This application is a continuation-in-part of prior application Ser. No. 08/538,026, filed on Oct. 2, 1995, is on Nov. 4, 1997, as U.S. Pat. No. 5,684,459.

FIELD OF THE INVENTION

This invention relates to active elements to be used in markers for magnetomechanical electronic article surveillance (EAS) systems, and to methods for making such active elements.

BACKGROUND OF THE INVENTION

U.S. Pat. No. 4,510,489, issued to Anderson et al., discloses a magnetomechanical EAS system in which markers incorporating a magnetostrictive active element are secured to articles to be protected from theft. The active elements are formed of a soft magnetic material, and the markers also include a control element (also referred to as a "bias element") which is magnetized to a pre-determined degree so as to provide a bias field which causes the active element to be mechanically resonant at a pre-determined frequency. The markers are detected by means of an interrogation signal generating device which generates an alternating magnetic field at the pre-determined resonant frequency, and the signal resulting from the magnetomechanical resonance is detected by receiving equipment.

According to one embodiment disclosed in the Anderson et al. patent, the interrogation signal is turned on and off, or "pulsed", and a "ring-down" signal generated by the active element after conclusion of each interrogation signal pulse is detected.

The disclosure of the Anderson et al. patent is incorporated herein by reference.

Typically, magnetomechanical markers are deactivated by degaussing the control element, so that the bias field is removed from the active element thereby causing a substantial shift in the resonant frequency of the active element. This technique takes advantage of the fact that the resonant frequency of the active element varies according to the level of the bias field applied to the active element. Curve 20 in FIG. 1A illustrates a bias-field-dependent resonant frequency characteristic typical of certain conventional active elements used in magnetomechanical markers. The bias field level $H_B$ shown in FIG. 1A is indicative of a level of bias field typically provided by the control element when the magnetomechanical marker is in its active state. The bias field level $H_B$ is sometimes referred to as the operating point. Conventional magnetomechanical EAS markers operate with a bias field of about 6 Oe to 7 Oe.

When the control element is degaussed to deactivate the marker, the resonant frequency of the active element is substantially shifted (increased) as indicated by arrow 22. In conventional markers, a typical frequency shift upon deactivation is on the order of 1.5 kHz to 2 kHz. In addition, there is usually a substantial decrease in the amplitude of the "ring-down" signal.

U.S. Pat. No. 5,469,140, which has common inventors and a common assignee with the present application, discloses a procedure in which a strip of amorphous metal alloy is annealed in the presence of a saturating transverse magnetic field. The resulting annealed strip is suitable for use as the active element in a magnetomechanical marker and has improved ring-down characteristics which enhance performance in pulsed magnetomechanical EAS systems. The active elements produced in accordance with the '140 patent also have a hysteresis loop characteristic which tends to eliminate or reduce false alarms that might result from exposure to harmonic-type EAS systems. The disclosure of the '140 patent is incorporated herein by reference.

Referring again to curve 20 in FIG. 1A, it will be noted that the curve has a substantial slope at the operating point. As a result, if the bias field actually applied to the active element departs from the nominal operating point $H_B$, the resonant frequency of the marker may be shifted to some extent from the nominal operating frequency, and may therefore be difficult to detect with standard detection equipment. U.S. Pat. No. 5,568,125, which is a continuation-in-part of the aforesaid '140 patent, discloses a method in which a transverse-field-annealed amorphous metal alloy strip is subjected to a further annealing step to reduce the slope of the bias-field-dependent resonant frequency characteristic curve in the region of the operating point. The disclosure of the '125 patent is incorporated herein by reference.

The techniques disclosed in the '125 patent reduce the sensitivity of the resulting magnetomechanical markers to variations in bias field without unduly diminishing the overall frequency shift which is desired to take place upon degaussing the control element. Although the teachings of the '125 patent represent an advance relative to manufacture of transverse-annealed active elements, it would be desirable to provide magnetomechanical EAS markers exhibiting still greater stability in resonant frequency.

OBJECTS AND SUMMARY OF THE INVENTION

It is an object of the invention to provide magnetomechanical EAS markers having improved stability in terms of resonant frequency relative to changes in bias field.

According to an aspect of the invention, there is provided a magnetostrictive element for use as an active element in a magnetomechanical electronic article surveillance marker, the magnetostrictive element being a strip of amorphous metal alloy that has been annealed so as to relieve stress in the magnetostrictive element, the magnetostrictive element having a resonant frequency that varies according to a level of a bias magnetic field applied to the magnetostrictive element and having a bias-field-dependent resonant frequency characteristic such that the resonant frequency of the magnetostrictive element varies by no more than 800 Hz as the bias field applied to the magnetostrictive element varies in the range of 4 Oe to 8 Oe. In a preferred embodiment of the invention, the resonant frequency of the magnetostrictive element varies by no more than 200 Hz over the bias field range of 4 to 8 Oe, and the resonant frequency shift of the magnetostrictive element when the bias field is reduced to 2 Oe from a level in that range is at least 1.5 kHz.

According to another aspect of the invention, there is provided a magnetomechanical electronic article surveillance marker, including an active element in the form of a strip of amorphous magnetostrictive metal alloy, and an element for applying a bias magnetic field at a level $H_B$ to the active element, $H_B$ being greater than 3 Oe, and the active element having been annealed to relieve stress therein and having a resonant frequency that varies according to a level of the bias magnetic field applied to the element, the active element having a bias-field-dependent resonant frequency characteristic such that the resonant frequency of the active element varies by no more than 600 Hz as the bias field applied to the active element varies in the range of ($H_B$ minus 1.5 Oe) to ($H_B$ plus 1.5 Oe). Preferably, the resonant frequency of the active element varies by no more than 200 Hz as the bias field varies above or below the operating point $H_B$ by as much as 1.5 Oe. Further in accordance with this aspect of the invention, the resonant frequency of the active element is shifted by at least 1.5 kHz when the bias field applied to the active element is reduced from $H_B$ to 2 Oe.

According to a further aspect of the invention, there is provided a magnetostrictive element for use as an active element in a magnetomechanical electronic article surveillance marker, the magnetostrictive element being a strip of amorphous metal alloy and having been annealed so as to relieve stress in the magnetostrictive element, the magnetostrictive element having a resonant frequency that varies according to a level of a bias magnetic field applied to the element and having a bias-field-dependent resonant frequency characteristic that has a slope of substantially zero at a point in the range of bias field levels defined as 3 Oe to 9 Oe.

According to yet another aspect of the invention, there is provided a magnetomechanical electronic article surveillance marker, including an active element in the form of a strip of amorphous magnetostrictive metal alloy, and an element for applying a bias magnetic field at a level $H_B$ to the active element, $H_B$ being greater than 3 Oe, and the active element having been annealed to relieve stress therein and having a resonant frequency that varies according to a level of the bias magnetic field applied to the active element, the active element having a bias-field-dependent resonant frequency characteristic that has a slope of substantially zero at a point in the range of bias field levels defined as ($H_B$ minus 1.5 Oe) to ($H_B$ plus 1.5 Oe).

According to yet a further aspect of the invention, there is provided a magnetostrictive element for use as an active element in a magnetomechanical electronic article surveillance marker, the element being a strip of amorphous metal alloy which has been annealed so as to relieve stress in the magnetostrictive element, the magnetostrictive element having a resonant frequency that varies according to a level of a bias magnetic field applied to the magnetostrictive element and also having a bias-field-dependent resonant frequency characteristic such that the resonant frequency of the magnetostrictive element is at a minimum level at a point in the range of bias field levels defined as 3 Oe to 9 Oe.

According to still another aspect of the invention, there is provided a magnetomechanical electronic article surveillance marker including an active element in the form of a strip of amorphous magnetostrictive metal alloy, and an element for applying a bias magnetic field at a level $H_B$ to the active element, $H_B$ being greater than 3 Oe, and the active element having been annealed to relieve stress therein, and having a resonant frequency that varies according to a level of the bias magnetic field applied to the active element, the active element having a bias-field-dependent resonant frequency characteristic such that the resonant frequency of the active element is at a minimum level at a point in the range of bias field levels defined as ($H_B$ minus 1.5 Oe) to ($H_B$ plus 1.5 Oe).

According to yet another aspect of the invention, there is provided a magnetostrictive element for use as an active element in a magnetomechanical electronic article surveillance marker, formed by heat-treating a strip of amorphous metal alloy while applying an electrical current along the strip. The alloy may have a composition consisting essentially of $Fe_aNi_bCo_cB_dSi_e$, with $30 \leqq a \leqq 80$, $0 \leqq b \leqq 40$, $0 \leqq c \leqq 40$, $10 \leqq d+e \leqq 25$. A preferred composition is $Fe_{37.85}Ni_{30.29}Co_{15.16}B_{15.31}Si_{1.39}$, which composition is preferably heat-treated for 3 minutes at 340° C. while applying a longitudinal current of 2 amperes.

According to still another aspect of the invention, there is provided a method of forming a magnetostrictive element for use in a magnetomechanical marker, including the steps of annealing an amorphous metal alloy strip, and during the annealing step, applying an electrical current along the length of the strip.

According to yet another aspect of the invention, there is provided a method of forming a magnetostrictive element for use in a magnetomechanical EAS marker, including the steps of annealing an amorphous metal alloy strip during application of a magnetic field directed transverse to the longitudinal axis of the strip, and subsequent to the annealing step, applying an electrical current along the longitudinal axis of the strip. According to further aspects of the invention, during the application of the electrical current along the longitudinal axis, a magnetic field or tension is applied along the longitudinal axis of the strip.

According to yet another aspect of the invention, there is provided a magnetomechanical EAS marker, including an active element in the form of a strip of amorphous magnetostrictive metal alloy having a composition consisting essentially of $Fe_aNi_bCo_cCr_dNb_eB_fSi_g$, and an element for applying a bias magnetic field at a level $H_B$ to the active element, $H_B$ being greater than 3 Oe, and the active element having been annealed to relieve stress therein and having a magnetomechanical coupling factor k at the bias level $H_B$, such that $0.3 \leqq k \leqq 0.4$, with $69 \leqq a+b+c \leqq 75$; $26 \leqq a \leqq 45$; $0 \leqq b \leqq 23$; $17 \leqq c \leqq 40$; $2 \leqq d+e \leqq 8$; $0 \leqq d$; $0 \leqq e$; $20 \leqq f+g \leqq 23$; $f \geqq 4g$.

According to a further aspect of the invention, there is provided a magnetostrictive element for use as an active element in a magnetomechanical electronic article surveillance marker, the element being a strip of amorphous metal alloy and having been annealed so as to relieve stress in the element, the element having a magnetomechanical coupling factor k in a range of about 0.3 to 0.4 at a bias field level that corresponds to a minimum resonant frequency of the element, the alloy including iron, boron and no more than 40% cobalt. Further in accordance with this aspect of the invention, the alloy may include from 2 to 8% chromium and/or niobium. The alloy in such element preferably also includes nickel.

DESCRIPTION OF PREFERRED EMBODIMENTS AND PRACTICES

Figure 1A:
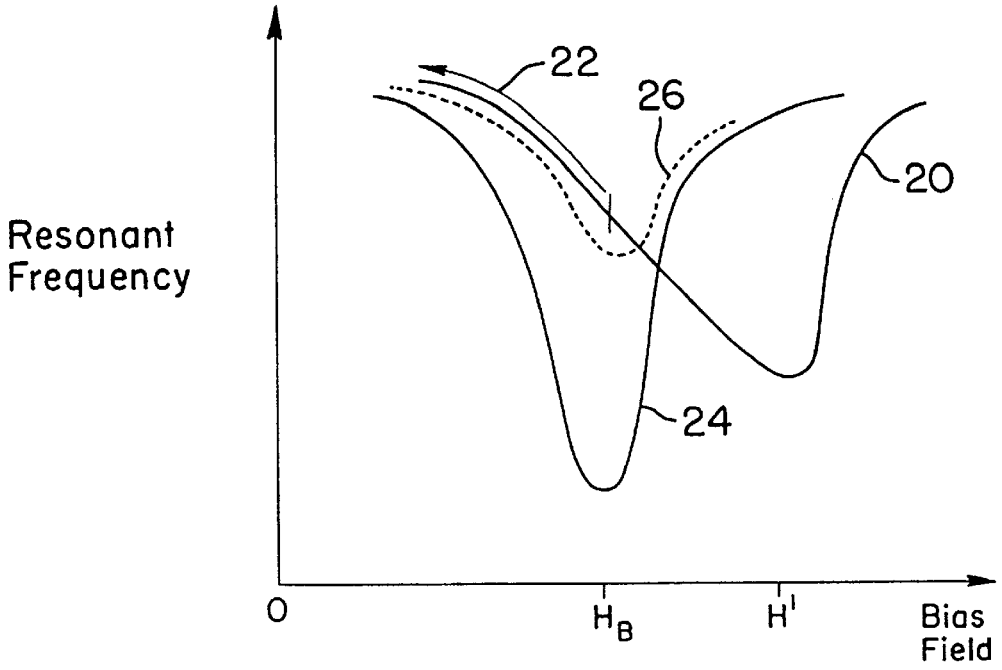
FIG. 1A illustrates bias-field-dependent resonant frequency characteristics of magnetomechanical markers provided in accordance with conventional practice and in accordance with the present invention.

Referring again to FIG. 1A, it will be observed that the resonant frequency characteristic curve 20 of the prior art transverse-field-annealed active element has a minimum at a bias field value of about H'. The value of H' substantially corresponds to the anisotropy field ($H_a$), which is the longitudinal field required to overcome the transverse anisotropy formed by transverse-field annealing. A typical level for H' (the level corresponding to the minimum resonant frequency) for the conventional transverse-field-annealed active elements is around (11–15 Oe).

It could be contemplated to change the operating point to the bias field level H' corresponding to the minimum of the characteristic curve 20. In this case, variations in the effective bias field would not cause a large change in resonant frequency, since the slope of the characteristic curve 20 is essentially zero at its minimum, and is otherwise at a low level in the region around H'. There are, however, practical difficulties which would prevent satisfactory operation at H' with the conventional transverse-field-annealed active element.

The most important difficulty is related to the magnetomechanical coupling factor k of the active element if biased at the level H'. As seen from FIGS. 1B and 1C, the coupling factor k has a peak (FIG. 1C), at substantially the same bias level at which the resonant frequency has its minimum (FIG. 1B; the horizontal scales indicative of the bias field level are the same in FIGS. 1B and 1C). The solid line portion of the curves shown in FIGS. 1B and 1C corresponds to theoretical models, as well as measured values, for the well of the resonant frequency and the peak of the coupling factor k. The dotted line portion of the curves shows a rounded minimum of the frequency curve and a rounded peak of the coupling factor as actually measured and contrary to the theoretical model. For the conventional transverse-field-annealed material, the peak coupling factor k is about 0.45, which is significantly above the optimum coupling factor 0.3. With a coupling factor k at 0.45, the so-called "quality factor" or Q of the active element would be substantially lower than at the conventional operating point $H_B$ so that the active element, when resonating, would dissipate energy much more rapidly, and therefore would have a lower ring-down signal which could not be detected with conventional pulsed-field detection equipment.

Moreover, the bias element that would be required to provide the higher level bias field H' would be larger and more expensive than conventional bias elements, and more prone to magnetically clamp the active element, which would prevent the marker from operating.

The difficulties that would be caused by the larger bias element could be prevented by changing the annealing process applied to form the conventional transverse-field-annealed active element so that the anisotropy field $H_a$ substantially corresponds to the conventional operating point $H_B$. The resulting resonant frequency characteristic is represented by curve 24 in FIG. 1A. Although this characteristic exhibits a minimum and zero slope at or near the conventional operating point, the frequency "well" has very steep sides so that a minor departure of the bias field from the nominal operating point could lead to significant variations in resonant frequency. Furthermore, the peak level of the coupling factor k which corresponds to the frequency minimum of the characteristic curve 24 is substantially above the optimum level 0.3, resulting in fast ring-down and an unacceptably low ring-down signal amplitude.

Figure 1B:
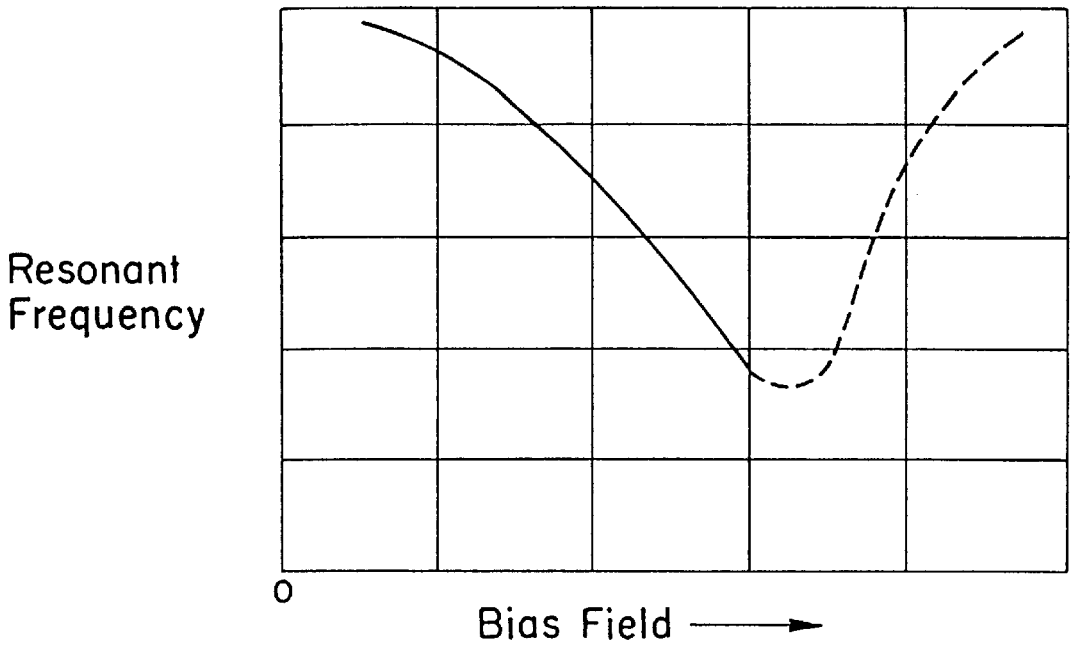
FIGS. 1B and 1C illustrate, respectively, a resonant frequency characteristic, and a magnetomechanical coupling factor (k) characteristic, of a magnetostrictive element provided in accordance with the invention.

According to examples provided below, a novel active element is formed that has a resonant frequency characteristic such as that represented by dotted line curve 26 of FIG. 1A, with a minimum at or near the conventional operating point $H_B$ and a coupling factor k at or near the optimum 0.3 at the operating point. Preferably, the active element provided according to the invention also exhibits a substantial resonant frequency shift when the bias element is degaussed.

Two different approaches are employed to provide an active element having these desirable characteristics. According to a first approach, novel processes are applied to ribbons formed of amorphous alloy compositions that are similar to compositions used in conventional active elements. According to a second approach, a conventional cross-field annealing process is applied to ribbons formed of novel amorphous alloy compositions.

EXAMPLE 1

An amorphous ribbon having the composition $Fe_{37.85}Ni_{30.29}Co_{15.16}B_{15.31}Si_{1.39}$ was annealed in an oven maintained at a temperature of 340° C. for 3 minutes. (It should be understood that all alloy compositions recited in this application and the appended claims are stated in terms of atomic percent.)

At the same time, a two ampere current was applied along the length of the ribbon to induce a circular anisotropy around a central longitudinal axis of the ribbon. The ribbon has substantially the same geometry as a conventional type of transverse-field-annealed active element, namely a thickness of about 25 microns, a width of about 6 mm, and a length of about 37.6 mm.

Figure 2:
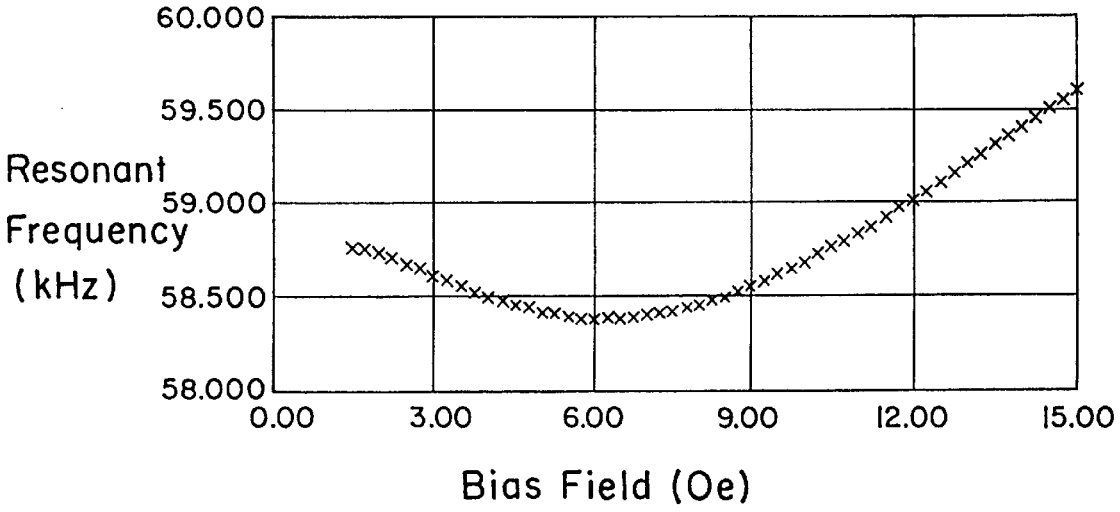
FIG. 2 illustrates a bias-field-dependent resonant frequency characteristic of a magnetostrictive element formed by current-annealing in accordance with the present invention.

FIG. 2 illustrates the bias-field-dependent resonant frequency characteristic of the resulting active element. It will be observed that the characteristic exhibits a minimum, and substantially zero slope, at around 6 Oe and has very low slope over a range of 4 Oe to 8 Oe. Varying the bias field throughout this range results in no more than about a 200 Hz variation in the resonant frequency. Although reducing the bias field from 6 Oe to less than 2 Oe does not produce a large shift in resonant frequency, such a reduction in bias field does significantly reduce the output signal amplitude.

Figure 3:
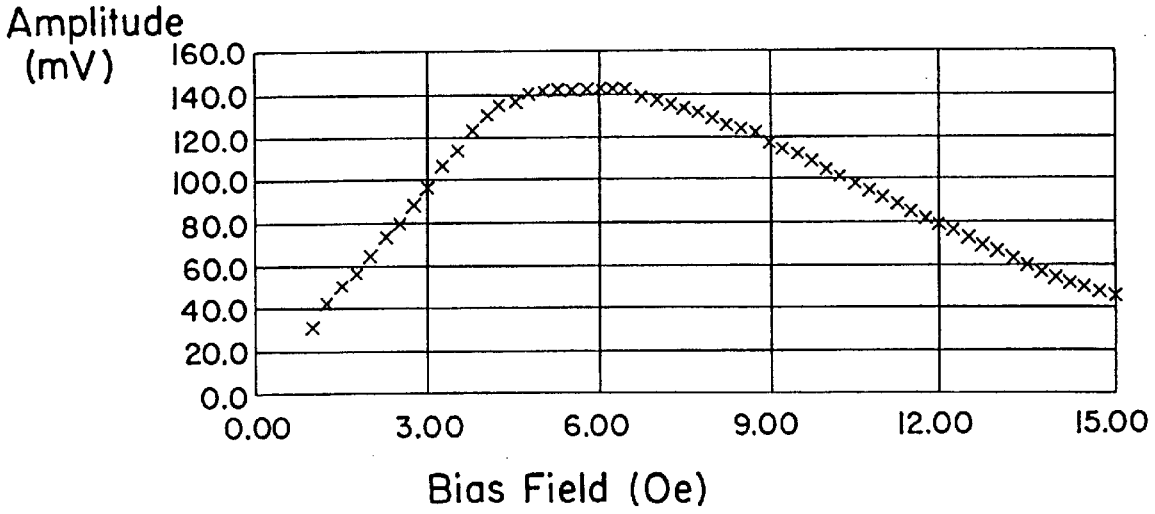
FIG. 3 is a bias-field-dependent output signal amplitude characteristic of the magnetostrictive element referred to in connection with FIG. 2.

FIG. 3 presents a bias-field-dependent output signal characteristic indicating the output signal amplitude provided one millisecond after the end of the interrogation field pulse (sometimes known as the "Al" signal). FIG. 3 indicates that the Al signal has a peak of substantially 140 millivolts at around 6 Oe. This is an acceptable signal level for existing magnetomechanical EAS systems. The peak of the curve shown in FIG. 3 is rather flat around 6 Oe so that variations in the bias field around the operating point do not greatly reduce the output signal level. Moreover, when the bias field is reduced from 6 Oe to about 1 or 2 Oe, there is a very large reduction in the output signal.

The active element produced in this example is suitable for use in so-called "hard-tag" applications, in which the markers are removed from the article of merchandise upon checkout and for which deactivation by degaussing the control element may not be required. Further, depending on the dynamic range of the detection equipment employed, the reduction in output signal resulting from degaussing the control element may also permit the active element produced in this example to be used in a deactivatable magnetomechanical marker, notwithstanding the relatively small resonant frequency shift caused by removing the bias field.

It is believed that the current annealing technique described in this example can be applied to most amorphous alloys having magnetostriction. More specifically, it is believed that alloys having the composition $Fe_aNi_bCo_cB_dSi_e$, with $30 \leqq a \leqq 80$, $0 \leqq b \leqq 40$, $0 \leqq c \leqq 40$, $10 \leqq d+e \leqq 25$, can be treated with current annealing to produce a resonant frequency characteristic like that of curve 26 in FIG. 1A, with a minimum at the conventional bias field operating point, a coupling factor k in the range 0.3 to 0.4 at the operating point, and a substantial reduction in output signal and/or a substantial resonant frequency shift upon removal of the bias field.

EXAMPLE 2

A continuous ribbon of the same material used in Example 1 was continuously annealed at a speed of 24 feet per minute and temperature of 360° C., in the presence of a saturating transverse magnetic field. The effective heating path through the heating facility has a length of about 6 feet so that the effective duration of the transverse-field annealing is about 15 seconds. After the transverse-field annealing, a second processing step was performed in which a three ampere current was applied along the length of the ribbon, in the presence of a 5 Oe magnetic field applied along the length of the ribbon, for 10 minutes.

Figure 4:
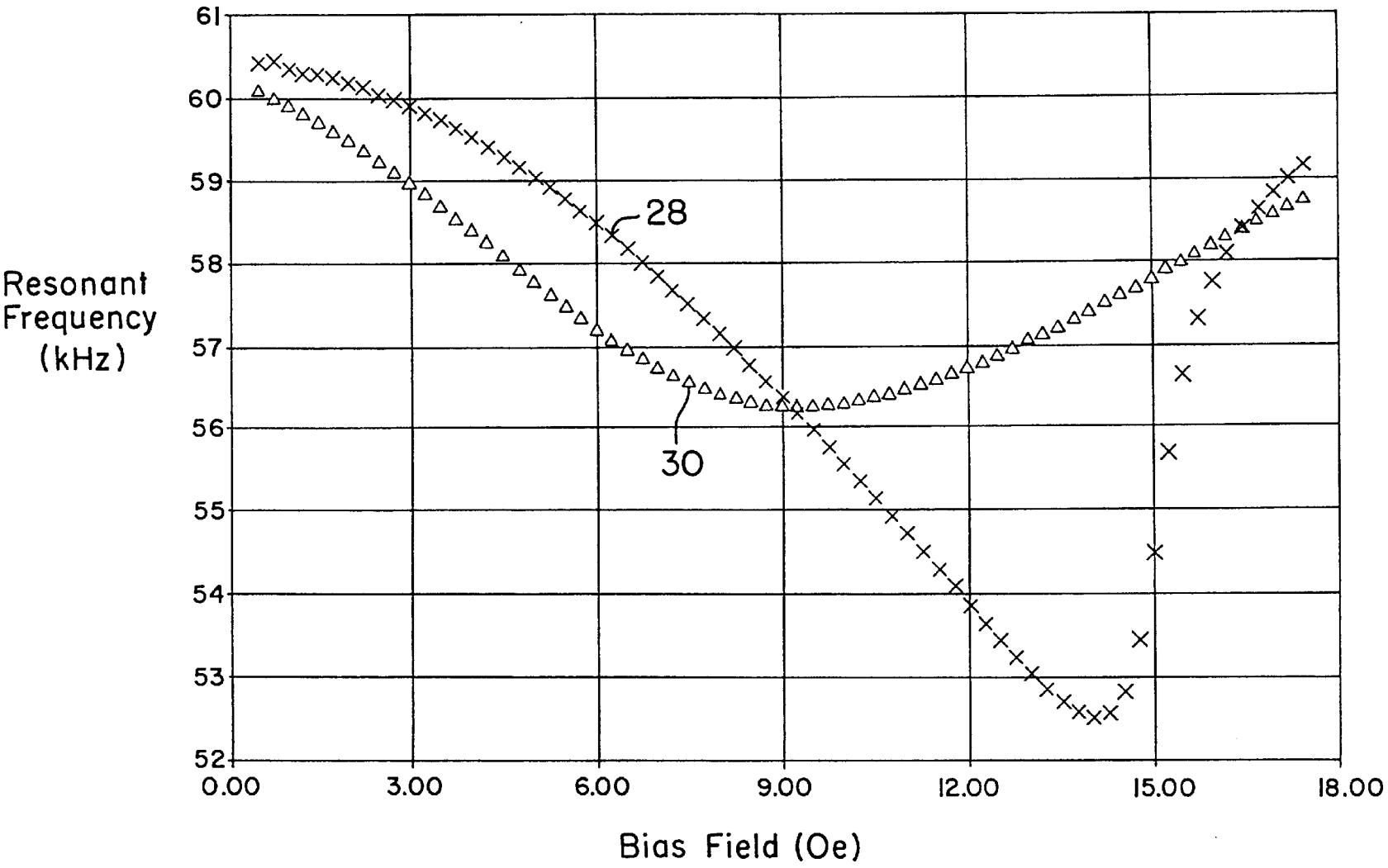
FIG. 4 illustrates resonant frequency characteristics of an active element provided in accordance with the invention as exhibited before and after a current-annealing process step.

FIG. 4 shows bias-field-dependent resonant frequency characteristics for the active element produced in accordance with this Example 2 after the transverse-field anneal and prior to the current-treatment step ("cross-mark" curve 28), and after the current-treatment step (triangle-mark curve 30). It will be recognized that the post-current-treatment characteristic represented by the curve 30 has a minimum, and substantially zero slope, at around 9 Oe, a low slope in the region of the conventional operating point (6 to 7 Oe), and a substantial frequency shift if the bias field is removed.

Figure 5:
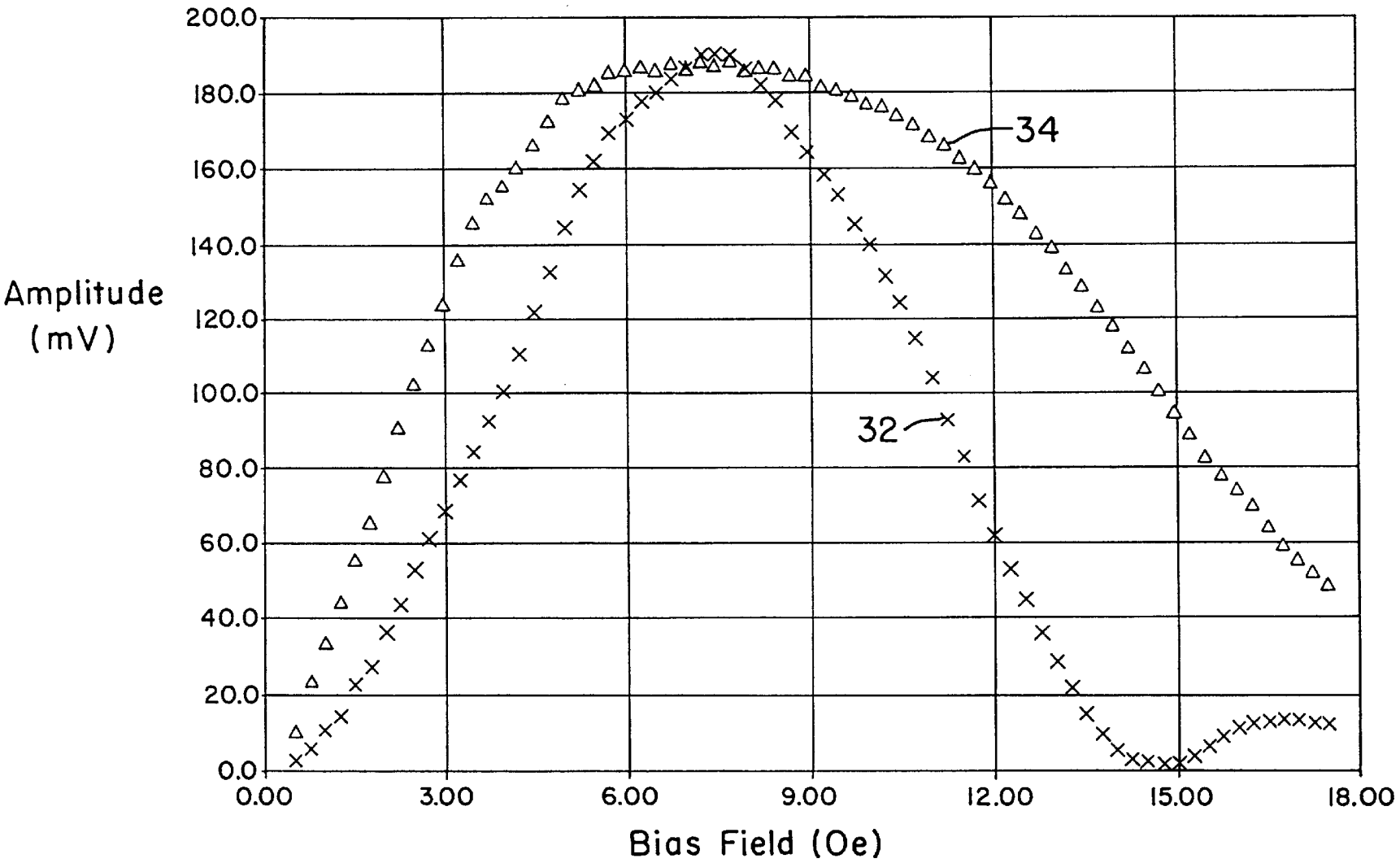
FIG. 5 illustrates output signal amplitude characteristics of the magnetostrictive element referred to in connection with FIG. 4, before and after the current-annealing step.

FIG. 5 shows the bias-field-dependent Al signal characteristics for the material. As before, the cross-mark curve (reference numeral 32) represents the characteristic obtained after the transverse-field-annealing but before the current-treatment step, whereas the triangle-mark curve (reference 34) represents the characteristic obtained after the current-treatment step. It will be observed that both before and after the current-treatment, a peak amplitude of more than 180 millivolts is achieved near the conventional operating point. Further, the amplitude characteristic provided by the current-treated material is much broader at the peak, so that a high signal level can be obtained even if the operating point is moved to 9 Oe, which is where the resonant frequency is most stable. Thus the transverse-field-annealed and then current-treated material produced in this Example 2 provides the desired characteristics of resonant frequency stability, high-ring down signal output (optimal k and satisfactory Q) at the resonant frequency well, and substantial frequency shift upon removal of the bias field.

EXAMPLE 3

Figure 11:
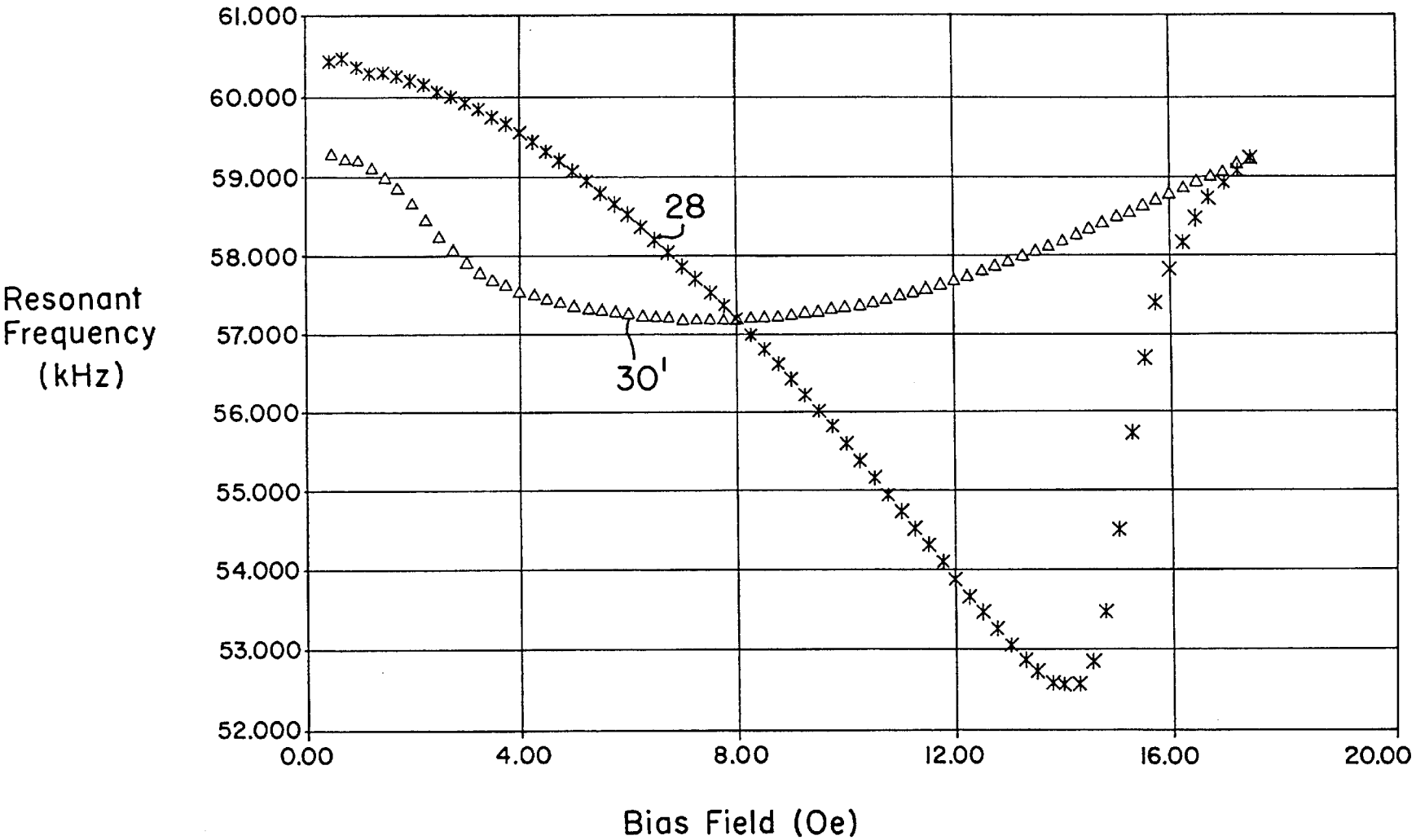
FIG. 11 illustrates resonant frequency characteristics of another example of an active element provided in accordance with the invention as exhibited before and after a current-annealing process step.
Figure 12:
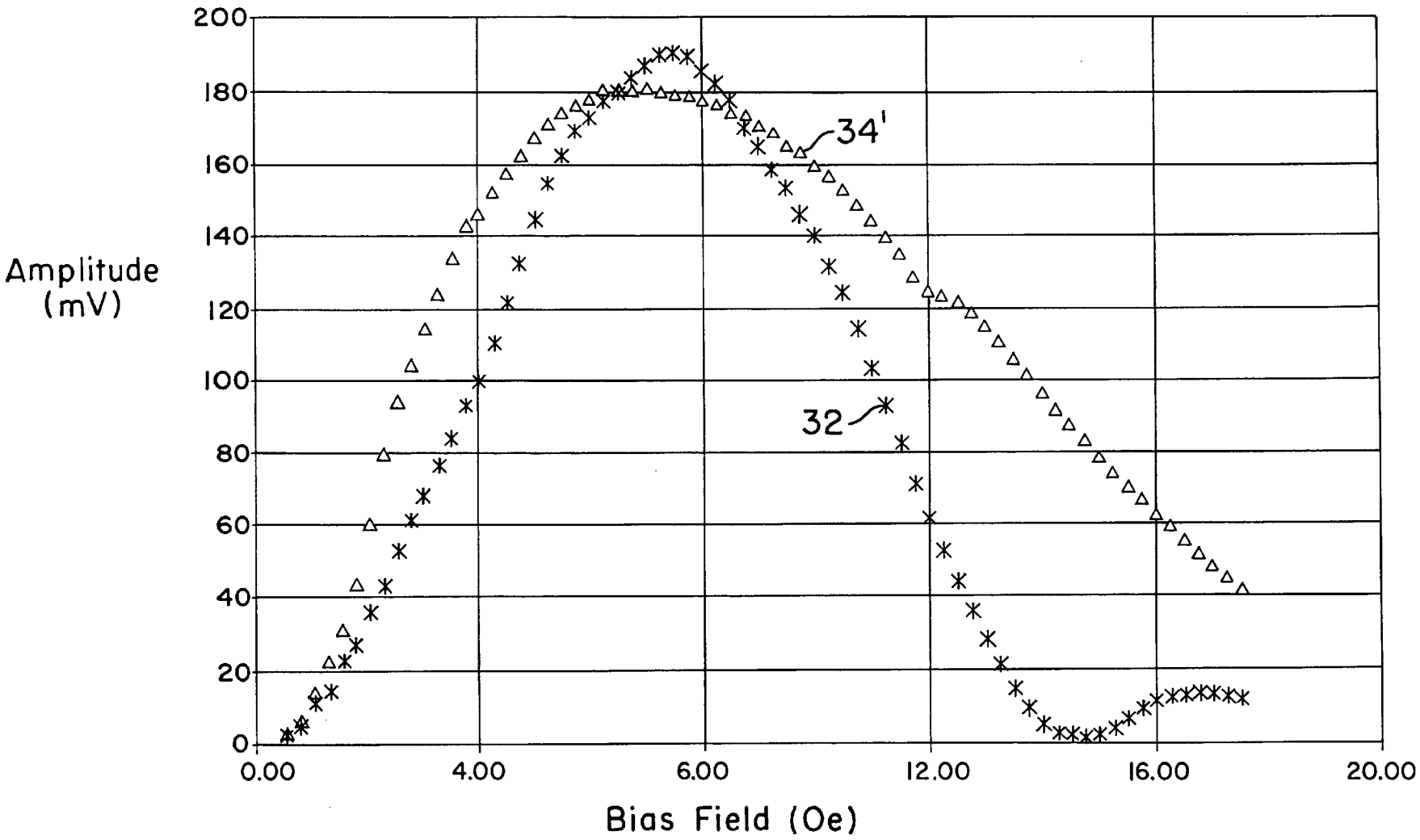
FIG. 12 illustrates output signal amplitude characteristics of the magnetostrictive element referred to in connection with FIG. 11, before and after the current-annealing step.

The same material was continuously annealed in the same manner as in Example 2, and then the current-treatment step was performed with a current of 2.8 amperes applied along the length of the ribbon, in the presence of the 5 Oe longitudinal field, for 3 minutes. The resulting resonant frequency and amplitude characteristics are shown, respectively, as curve 30' in FIG. 11 and curve 34' in FIG. 12.

It will be noted that the current-treatment according to this Example 3 has moved the minimum resonant frequency close to the conventional operating point, with low slope over a wide range around the operating point, a substantial frequency shift (about 2 kHz) on deactivation, and a satisfactory Al signal level at the operating point.

Up to this point, the examples provided have disclosed novel treatments, applied to materials similar to those used for conventional annealed active elements, to produce the desired improvement in resonant frequency stability. However, it is also contemplated to achieve the desired increase in stability by applying conventional cross-field annealing techniques to novel amorphous metal alloy materials.

As noted above, it has been found that a magnetomechanical coupling factor k of 0.3 corresponds to a maximum ring-down signal level. For k in the range 0.28 to 0.40 satisfactory signal amplitude is also provided. If k is greater than 0.4, the output signal amplitude is substantially reduced, and if k is much less than 0.3 the initial signal level produced by the interrogation pulse is reduced, again leading to reduced ring-down output level. A preferred range for k is about 0.30 to 0.35.

It has been shown that for a material having a transverse anisotropy, the coupling coefficient k is related to the magnetization $M_S$ at saturation, the magnetostriction coefficient $\lambda_S$, the anisotropy field $H_a$, Young's modulus at saturation $E_M$, and the applied longitudinal field H according to the following equation:

$$k^2 = \frac{9\lambda_S{}^2 E_M H^2}{M_S H_a{}^3 + 9\lambda_S{}^2 E_M H^2} \tag{1}$$

This relationship is described in "Magnetomechanical Properties of Amorphous Metals." J. D. Livingston, *Phys. Stat. Sol.,* (a) 70, pp. 591–596 (1982).

Figure 1C:
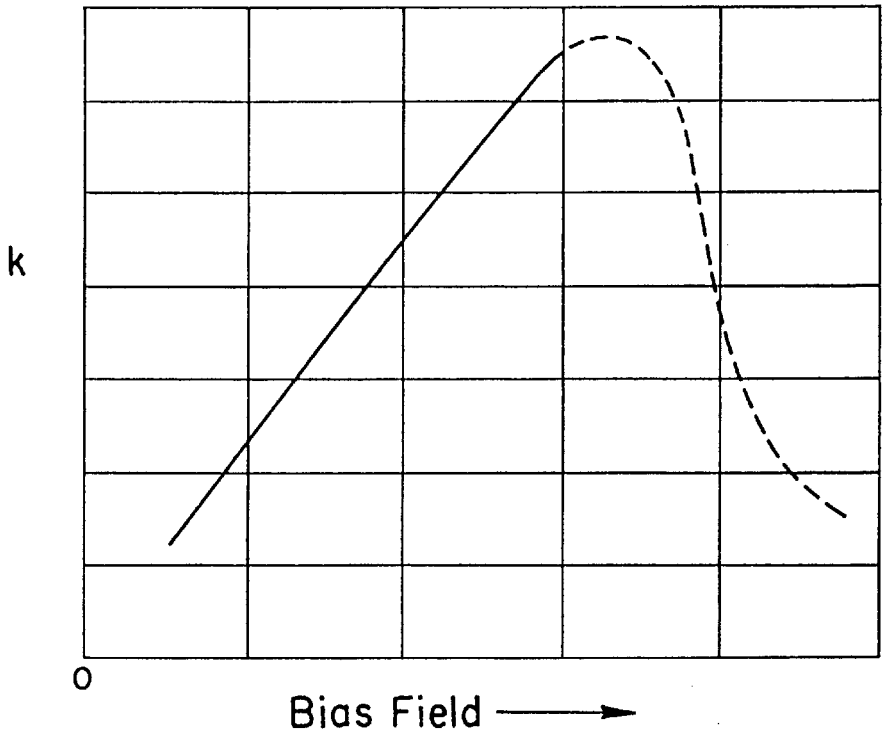

The relationship represented by Equation (1) holds only for values of H less than or equal to $H_a$, above which field level, in theory, k drops to zero. For real materials, however, the k characteristic exhibits a rounded peak of $H=H_a$ followed by a tail, as shown in FIG. 1C.

For amorphous materials used as active elements, $E_M$ has a value of about $1.2\times10^{12}$ erg/cm$^3$. The desired operating point implies a level of $H_a$ of 6 Oe. To produce an active element having the characteristic curve 26 shown in FIG. 1A, rather than the curve 24, it is desirable that k be in the range 0.28 to 0.4 when H approaches $H_a$. This requires a substantial reduction in k relative to the material that would have the characteristic represented by curve 24. Taking $E_M$, H, and $H_a$ as constants, it can be seen that k can be reduced by reducing the magnetostriction $\lambda_S$ and/or by increasing the magnetization $M_S$. Increasing the magnetization is also beneficial in that the output signal is also increased, but the level of saturation magnetization that is possible in amorphous magnetic material is limited.

Solving Equation (1) for the magnetostriction $\lambda_S$ yields the following relation:

$$\lambda_S = \frac{k\sqrt{M_S H_a^3}}{3H\sqrt{E_M(1-k^2)}} \tag{2}$$

For given values of k, H, $H_a$, $E_M$, it will be seen that the magnetostriction is proportional to the square root of the magnetization.

Taking H=5.5 Oe, and with $H_a$ and $E_M$ having the values noted before, FIG. 6 shows plots of magnetostriction versus magnetization for k=0.3 and k=0.4. A desirable region in the magnetostriction-magnetization space is indicated by the shaded region referenced at 36 in FIG. 6. The preferred region 36 lies between the curves corresponding to k=0.3 and k=0.4 at around $M_S$=1000 Gauss.

Figure 6:
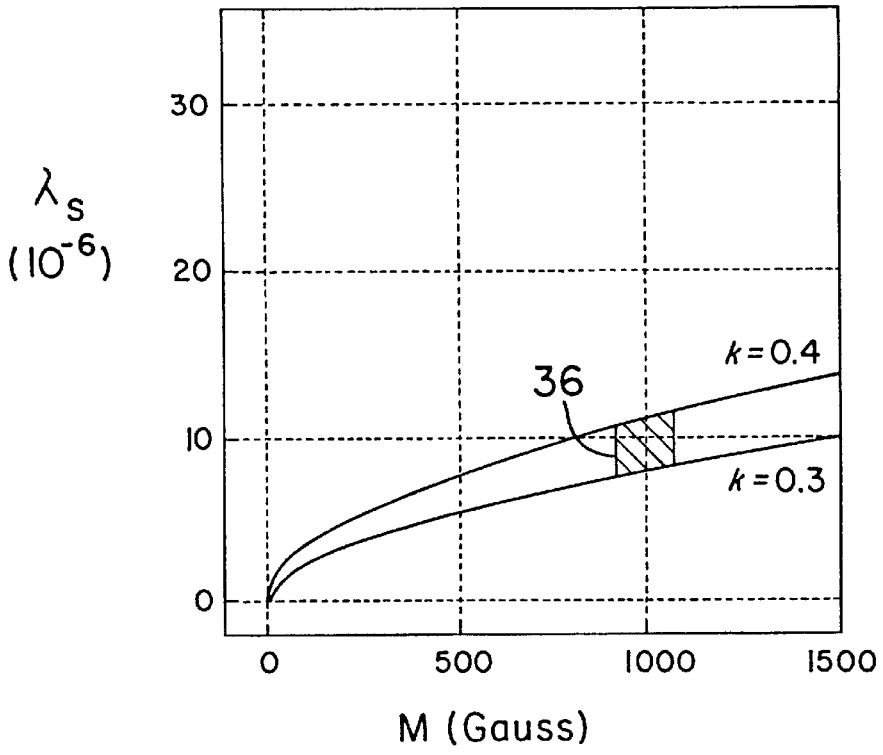
FIG. 6 illustrates a preferred range of the magnetomechanical coupling factor k in magnetostriction-magnetization space.
Figure 7:
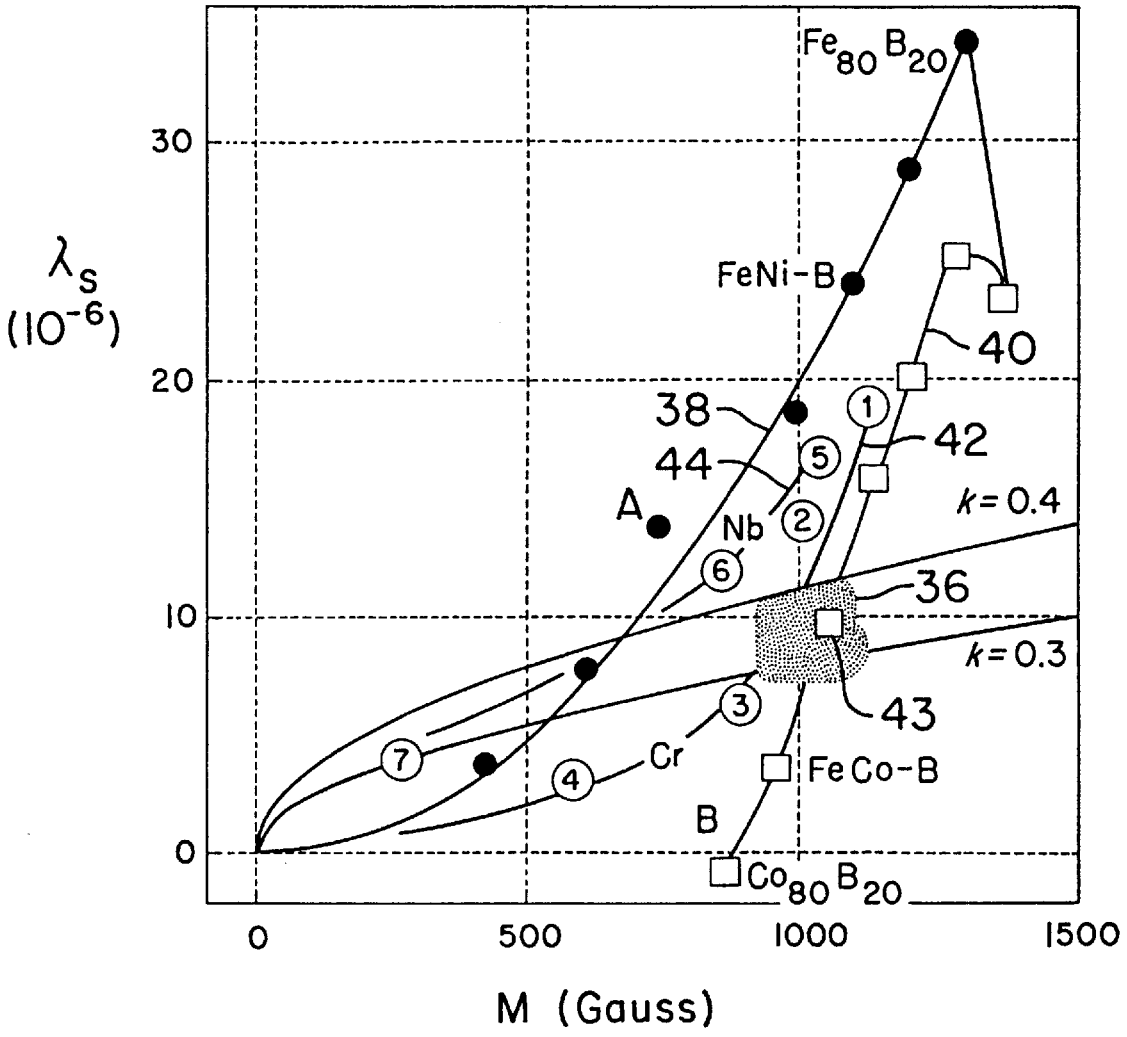
FIG. 7 adds to the illustration of FIG. 6 graphical representations of characteristics in magnetostriction-magnetization space of various alloy compositions.

FIG. 7 is similar to FIG. 6, with magnetostriction-magnetization characteristics of a number of compositions superimposed. Curve 38 in FIG. 7 represents a range of compositions from $Fe_{80}B_{20}$ to $Fe_{20}Ni_{60}B_{20}$. It will be observed that the FeNiB curve 38 misses the desired region 36 and can be expected to result in undesirably high levels of k in the region corresponding to the desired levels of magnetization. For example, the point labeled A corresponds to a composition known as Metglas 2826MB, which is about $Fe_{40}Ni_{38}Mo_4B_{18}$, and has an undesirably high coupling factor k. The 2826MB alloy is used as-cast (i.e., without annealing) as the active element in some conventional magnetomechanical markers. The casting process is subject to somewhat variable results, including variations in transverse anisotropy, so that in some cases the 2826MB material has a level of $H_a$ close to the conventional operating point, although $H_a$ for 2826MB as-cast is typically substantially above the conventional operating point.

The curve 40 corresponds to Fe—Co—B alloys and passes through the desired region 36. The point referred to at 43 on curve 40 is within the preferred region 36 and corresponds to $Fe_{20}Co_{60}B_{20}$. Although the latter composition can be expected to have a desirable coupling factor k at the preferred operating point, such a material would be quite expensive to produce because of the high cobalt content. It will be noted that at point B, which is approximately $Co_{74}Fe_6B_{20}$, there is substantially zero magnetostriction.

The data for curves 38 and 40 is taken from "Magnetostriction of Ferromagnetic Metallic Glasses", R. C. O'Handley, *Solid State Communications,* vol. 21, pages 1119–1120, 1977.

The present invention proposes that an amorphous metal alloy in the preferred region 36 be formed with a lower cobalt component by adding a few atomic percent of chromium and/or niobium to the amorphous metal composition.

A curve 42 is defined by points 1, 2, 3, 4, and corresponds to a range of FeCrB alloys. These four points are, respectively, $Fe_{80}Cr_3B_{17}$; $Fe_{78}Cr_5B_{17}$; $Fe_{77}Cr_6B_{17}$; and $Fe_{73}Cr_{10}B_{17}$.

Curve 44 is defined by points 5–7 and corresponds to a range of FeNbB alloys. The points 5–7 shown on curve 44 are, respectively, $Fe_{80}Nb_3B_{17}$; $Fe_{78}Nb_5B_{17}$; and $Fe_{73}Nb_{10}B_{17}$. It will be noted that for the desired level of magnetization, the curves 42 and 44 are at a lower level of magnetostriction than the FeNiB curve 38. Point 6 on the FeNbB curve 44 provides substantially the same magnetostriction-magnetization characteristics as the alloy $Fe_{32}Co_{18}Ni_{32}B_{13}Si_5$ used to produce the transverse-field-annealed active elements according to the teachings of the above-referenced '125 patent.

It is also desirable to provide some silicon in addition to the boron to improve the quality of the amorphous ribbon as-cast.

A preferred range of compositions, having the desired characteristics including a coupling factor k in or near the range of about 0.3 to 0.4 at a bias field level which corresponds to a minimum of the resonant frequency characteristic curve is given by the formula $Fe_aNi_bCo_cCr_dNb_eB_fSi_g$, where $69\leqq a+b+c\leqq75$; $26\leqq a\leqq45$; $0\leqq b\leqq23$; $17\leqq c\leqq40$; $2\leqq d+e\leqq8$; 0d; $0\leqq e$; $20\leqq f+g\leqq23$; $f\geqq4g$. Examples i–vi falling within this range are listed in Table 1. Table 1 also includes values of magnetization and magnetostriction interpolated from the data shown on FIG. 7, and a coupling factor k calculated based on the indicated magnetization and magnetostriction and assuming a value of $H_a$=7.5 Oe.

TABLE 1

| Ex. No. | Composition (atom %) Fe | Co | Ni | Cr | Nb | B | Si | $M_s$ (Gauss) | $\lambda$ ($10^{-6}$) | $k_{max}$ |
|---|---|---|---|---|---|---|---|---|---|---|
| i. | 35 | 34 | 6 | 2 | 0 | 20 | 3 | 1000 | 12 | 0.4 |
| ii. | 31 | 30 | 15 | 2 | 0 | 19 | 3 | 900 | 10 | 0.36 |
| iii. | 31 | 30 | 15 | 0 | 2 | 19 | 3 | 800 | 12 | 0.445 |
| iv. | 38 | 27 | 7 | 6 | 0 | 19 | 3 | 1000 | 10 | 0.35 |
| v. | 33 | 21 | 17 | 6 | 0 | 20 | 3 | 800 | 9 | 0.35 |
| vi. | 40 | 18 | 14 | 6 | 0 | 19 | 3 | 900 | 9 | 0.33 |

Figure 8:
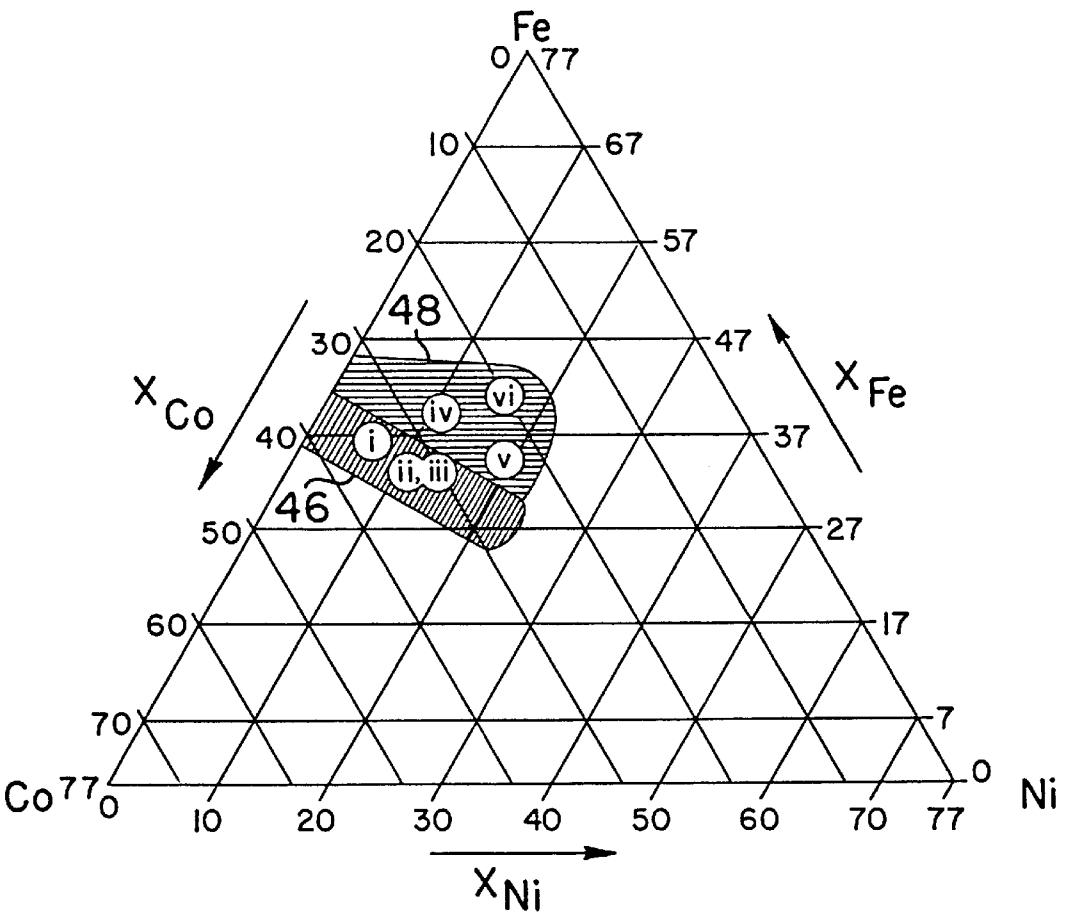
FIG. 8 is a ternary composition diagram indicating a preferred range of iron-nickel-cobalt based alloys incorporating chromium or niobium in accordance with the present invention.

FIG. 8 is a ternary diagram for alloys in which the combined proportion of iron, nickel and cobalt is approximately 77%, subject to reduction by a few percent to accommodate addition of a few percent of chromium and/or niobium. The obliquely-shaded region 46 in FIG. 8 corresponds to compositions having up to 3 or 4% niobium and/or chromium and having magnetization and magnetostriction characteristics expected to be in the preferred region 36 of FIGS. 6 and 7. It will be noted that the examples i–iii of Table 1 fall within the region 46. An adjoining horizontally shaded region 48 corresponds to compositions having 5–8% chromium that are also expected to be in the preferred region 36.

Figure 9:
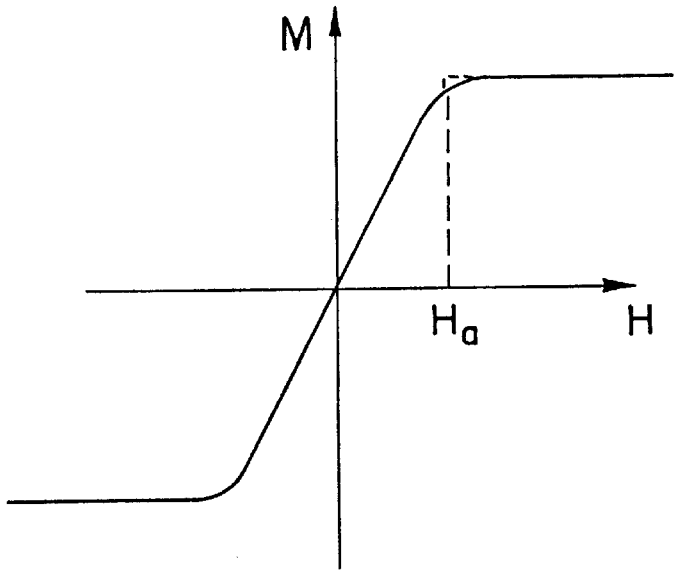
FIG. 9 illustrates an M-H loop characteristic of an active element provided in accordance with the invention.

A composition selected from the preferred range is to be transverse-field-annealed to generate a transverse anisotropy with a desired anisotropy field $H_a$ in the range of about 6 Oe to 8 Oe. The anisotropy field $H_a$ essentially corresponds to the "knee" portion of the M-H loop, as shown in FIG. 9.

The annealing temperature and time can be selected to provide the desired anisotropy field $H_a$ according to the characteristics of the selected material. For each material there is a Curie temperature $T_c$ such that annealing at that temperature or above produces no magnetic-field-induced anisotropy. The selected annealing temperature $T_a$ must therefore be below $T_c$ for the selected material. The composition of the material may be adjusted, according to known techniques, to set the Curie temperature $T_c$ at an appropriate point. Preferably $T_c$ is in the range 380°–480° C. A preferred value of $T_c$ is 450° C. It is preferred that annealing be carried out at a temperature from 10° C. to 100° C. less than $T_c$ for a time in the range of 10 seconds to 10 minutes, depending on the annealing temperature selected.

Figure 10:
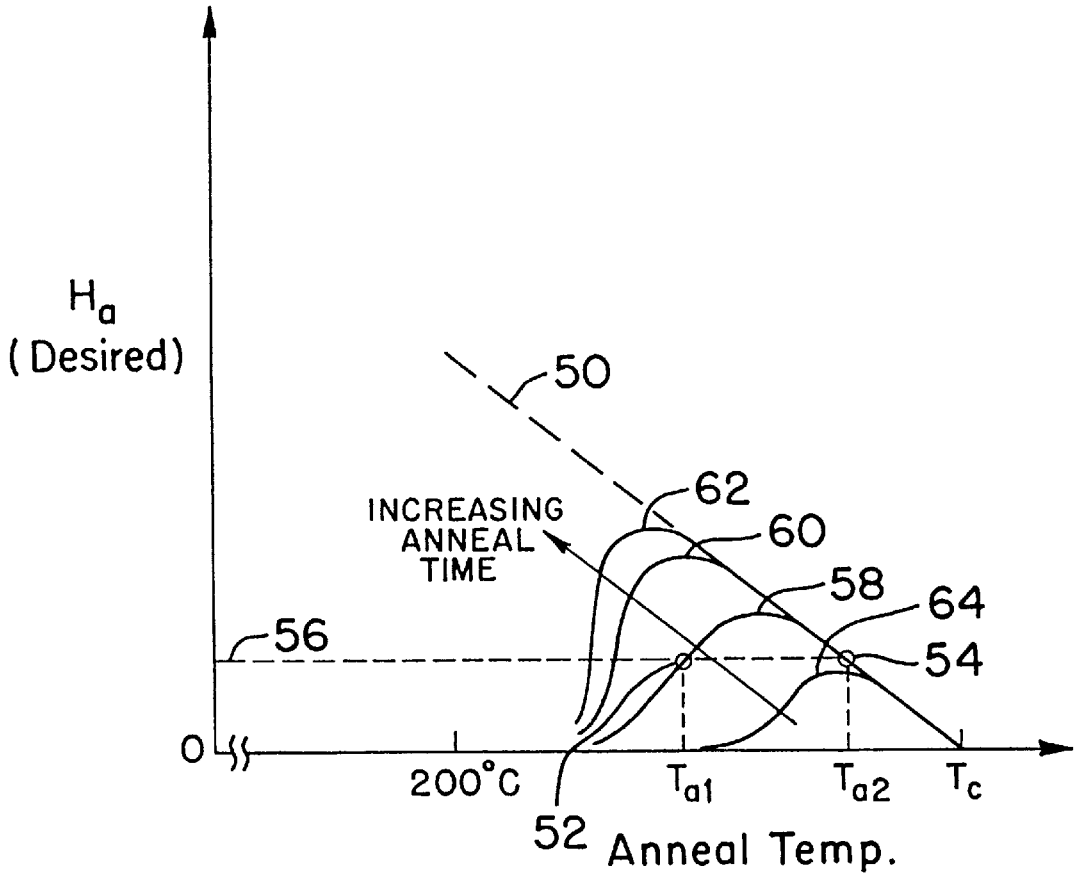
FIG. 10 illustrates variations in induced anisotropy according to changes in the temperature employed during cross-field annealing.

FIG. 10 illustrates how the resulting anisotropy field $H_a$ varies with annealing temperature and annealing time. For a given annealing temperature, a higher level of $H_a$ is achieved as the annealing time is increased, up to a limit indicated by line 50 in FIG. 10. The maximum level of $H_a$ that can be achieved for a selected annealing temperature generally increases as the difference between the annealing temperature and the Curie temperature $T_c$ increases. However, if the selected annealing temperature is too low to provide a sufficient amount of atomic relaxation in a reasonable time, then the anisotropy field $H_a$ will fail to reach its equilibrium strength indicated by line 50.

For a given desired level of $H_a$, there are two different annealing temperatures that may be selected for a given annealing time, as indicated at points 52 and 54, corresponding to annealing temperatures $T_{a1}$ and $Ta_2$, respectively, either of which may be selected to produce the $H_a$ level indicated by line 56 for the annealing time indicated by curve 58. Longer annealing times, represented by curves 60 and 62, would produce higher levels of $H_a$ if the temperature $T_{a1}$ were selected, but not if the temperature $T_{a2}$ were selected. A shorter annealing time, indicated by curve 64, would come close to producing the level of $H_a$ indicated by line 56 if the annealing temperature were $T_{a2}$, but would substantially fail to produce any field-induced anisotropy if temperature $T_{a1}$ were selected.

It is within the scope of the present invention to employ current-annealing and other heat-treatment practices in connection with the novel compositions disclosed herein, in addition to or in place of the transverse-field annealing described just above.

It is contemplated that the active elements produced in accordance with the present invention may be incorporated in magnetomechanical markers formed with conventional housing structures and including conventional bias elements. Alternatively, the bias elements may be formed of a low coercivity material such as those described in U.S. patent application Ser. No. 08/697,629, filed Aug. 28, 1996 (which has common inventors and a common assignee with the present application) . One such low coercivity material is designated as "MagnaDur 20-4", commercially available from Carpenter Technology Corporation, Reading, Pa. It is particularly advantageous to use active elements provided according to the present invention with a low-coercivity bias element because such bias elements are more susceptible than conventional bias materials to suffering a small decrease in magnetization upon exposure to relatively low level alternating magnetic fields. Although the low-coercivity bias elements are therefore somewhat likely to vary in a small way in terms of actual bias field provided by the bias element, such minor variations will not significantly shift the resonant frequency of the active elements provided in accordance with the present invention.

As another alternative technique for providing the bias field, it is contemplated to apply an invention described in co-pending U.S. patent application Ser. No. 08/800,772 entitled "Active Element for Magnetomechanical EAS Marker Incorporating Particles of Bias Material," filed simultaneously and having common inventors with the present application. According to the 772 application, crystals of semi-hard or hard magnetic material are formed within the bulk of an amorphous magnetically-soft active element, and the crystals are magnetized to provide a suitable bias field. No separate bias element would be required with such an active element.

Various changes in the above-disclosed embodiments and practices may be introduced without departing from the invention. The particularly preferred embodiments and practices of the invention are thus intended in an illustrative and not limiting sense. The true spirit and scope of the invention are set forth in the following claims.

What is claimed is:

1. A magnetomechanical electronic article surveillance marker comprising: a magnetostrictive element for use as an active element in said marker; said element being a strip of amorphous metal alloy, said element having been annealed so as to relieve stress in said element, said element having a resonant frequency that varies according to a level of a bias magnetic field applied to said element and having a bias-field-dependent resonant frequency characteristic such that the resonant frequency of said element varies by a total of no more than 800 Hz as the bias field applied to said element varies in the range of 4 Oe to 8 Oe.

2. A magnetomechanical electronic article surveillance marker according to claim 1, wherein the bias-field-dependent resonant frequency characteristic of said element is such that the resonant frequency of said element varies by a total of no more than 200 Hz as the bias field applied to said element varies in the range of 4 to 8 Oe.

3. A magnetomechanical electronic article surveillance marker according to claim 2, wherein the resonant frequency of said element shifts by at least 1.5 kHz when the bias field applied to said element is reduced to 2 Oe from a level in said range of 4 to 8 Oe.

4. A magnetomechanical electronic article surveillance marker according to claim 1, wherein the resonant frequency of said element shifts by at least 1.5 kHz when the bias field applied to said element is reduced to 2 Oe from a level in said range of 4 to 8 Oe.

5. A magnetomechanical electronic article surveillance marker, comprising:

an active element in the form of a strip of amorphous magnetostrictive metal alloy; and means for applying a magnetic bias at a level $H_B$ to said active element, $H_B$ being greater than 3 Oe;

said active element having been annealed to relieve stress therein, and having a resonant frequency that varies according to a level of the bias magnetic field applied to said element; said active element having a bias-field-dependent resonant frequency characteristic such that the resonant frequency of said active element varies by a total of no more than 600 Hz as the bias field applied to said active element varies in the range of $H_B$ minus 1.5 Oe to $H_B$ plus 1.05 Oe.

6. A magnetomechanical electronic article surveillance marker according to claim 5, wherein the bias-field-dependent resonant frequency characteristic of said active element is such that the resonant frequency of said active element varies by a total of no more than 200 Hz as the bias field applied to said active element varies in the range $H_B$ minus 1.05 Oe to $H_B$ plus 1.5 Oe.

7. A magnetomechanical electronic article surveillance marker according to claim 6, wherein the resonant frequency of said active element shifts by at least 1.5 kHz when the bias field applied to said active element is reduced to 2 Oe from $H_B$.

8. A magnetomechanical electronic article surveillance marker according to claim 5, wherein the resonant frequency of said active element shifts by at least 1.5 kHz when the bias field applied to said active element is reduced to 2 Oe from $H_B$.

9. A magnetomechanical electronic article surveillance marker comprising: a magnetostrictive element for use as an active element in said marker; said element being a strip of amorphous metal alloy, said element having been annealed so as to relieve stress in said element, said element having a resonant frequency that varies according to a level of a bias magnetic field applied to said element and having a bias-field-dependent resonant frequency characteristic that has a slope of substantially zero at a point in the range of bias field levels defined as 3 Oe to 9 Oe.

10. A magnetomechanical electronic article surveillance marker, comprising:

an active element in the form of a strip of amorphous magnetostrictive metal alloy; and means for applying a magnetic bias at a level $H_B$ to said active element, $H_B$ being greater than 3 Oe;

said active element having been annealed to relieve stress therein, and having a resonant frequency that varies according to a level of the bias magnetic field applied to said element; said active element having a bias-field-dependent resonant frequency characteristic that has a slope of substantially zero at a point in the range of bias field levels defined as 3 Oe to 9 Oe.

11. A magnetomechanical electronic article surveillance marker comprising: a magnetostrictive element for use as an active element in said marker; said element being a strip of amorphous metal alloy, said element having been annealed so as to relieve stress in said element, said element having a resonant frequency that varies according to a level of a bias magnetic field applied to said element and having a bias-field-dependent resonant frequency characteristic such that the resonant frequency of said element is at a minimum level at a point in the range of bias field levels defined as 3 Oe to 9 Oe.

12. A magnetomechanical electronic article surveillance marker, comprising:

an active element in the form of a strip of amorphous magnetostrictive metal alloy; and means for applying a bias magnetic field at a level $H_B$ to said active element, $H_B$ being greater than 3 Oe;

said active element having been annealed to relieve stress therein, and having a resonant frequency that varies according to a level of the bias magnetic field applied to said element; said active element having a bias-field-dependent resonant frequency characteristic such that the resonant frequency of said active element is at a minimum level at a point in the range of bias field levels defined as $H_B$ minus 1.5 Oe to $H_B$ plus 1.5 Oe.

13. A magnetomechanical electronic article surveillance marker comprising: a magnetostrictive element for use as an active element in said marker, said active element having been formed by heat-treating a strip of amorphous metal alloy while applying an electrical current along said strip, said alloy having a composition consisting essentially of $Fe_aNi_bCo_cB_dSi_e$, with $30 \leqq a \leqq 80$, $0 \leqq b \leqq 40$, $0 \leqq c \leqq 40$, $10 \leqq d+e \leqq 25$.

14. A magnetomechanical electronic article surveillance marker according to claim 13, wherein said alloy essentially has the composition $Fe_{37.85}Ni_{30.29}Co_{15.16}B_{15.31}Si_{1.39}$.

15. A magnetomechanical electronic article surveillance marker according to claim 13, wherein said heat-treatment is performed for 3 minutes in an oven maintained at a temperature of 340° C. and said electrical current has an amplitude of 2 amperes.

16. A method of forming a magnetostrictive element for use in a magnetomechanical EAS marker, comprising the steps of:

annealing an amorphous metal alloy strip; and during said annealing step, applying an electrical current along a length of said strip;

wherein said alloy has a composition consisting essentially of $Fe_aNi_bCo_cB_dSi_e$, with $30 \leqq a \leqq 80$, $0 \leqq b \leqq 40$, $0 \leqq c \leqq 40$, $10 \leqq d+e \leqq 25$.

17. A method according to claim 16, wherein said alloy essentially has the composition $Fe_{37.85}Ni_{30.29}Co_{15.16}B_{15.31}Si_{1.39}$.

18. A method according to claim 16, wherein said annealing is performed at temperature of 340° C. for 3 minutes and said electrical current has an amplitude of 2 amperes.

19. A method of forming a magnetostrictive element for use in a magnetomechanical EAS marker, comprising the steps of:

annealing an amorphous metal alloy strip during application of a magnetic field directed transverse to a longitudinal axis of said strip; and subsequent to said annealing step, applying an electrical current along said longitudinal axis of said strip;

wherein a magnetic field is applied along said longitudinal axis of said strip during said current-application step.

20. A method according to claim 19, wherein said current-application step is performed for 10 minutes.

21. A method according to claim 19, wherein tension is applied along said longitudinal axis of said strip during said current-application step.

22. A magnetomechanical electronic article surveillance marker comprising: a magnetostrictive element for use as an active element in said marker, said active element having been formed by heat-treating a strip of amorphous metal alloy and then, after said heat-treatment, applying an electrical current along said strip;

wherein said heat-treatment of said strip is performed in the presence of a magnetic field directed transversely to a longitudinal axis of said strip to induce a transverse anisotropy in said strip.

23. A magnetomechanical electronic article surveillance marker according to claim 22, wherein a magnetic field directed along said longitudinal axis of said strip is present during said application of electrical current.

24. A magnetomechanical EAS marker, comprising an active element in the form of a strip of amorphous magnetostrictive metal alloy having a composition essentially of $Fe_aNi_bCo_cCr_dNb_eB_fSi_g$; and means for applying a magnetic bias at a level $H_B$ to said active element, $H_B$ being greater that 3 Oe;

said active element having been annealed to relieve stress therein and having a magnetomechanical coupling factor k, such that $0.28 \leqq k \leqq 0.4$ at the applied bias level $H_B$;

with $69 \leqq a+b+c \leqq 75$; $26 \leqq a \leqq 45$; $0 \leqq b \leqq 23$; $17 \leqq c \leqq 40$; $2 \leqq d+e \leqq 8$; $0 \leqq d$; $0 \leqq e$; $20 \leqq f+g \leqq 23$; $f \geqq 4g$.

25. A magnetomechanical EAS marker according to claim 24, wherein said alloy has a composition selected from the group consisting of:

$Fe_{35}Co_{34}Ni_6Cr_2B_{20}Si_3$;

$Fe_{31}Co_{30}Ni_{15}Cr_2B_{19}Si_3$;

$Fe_{31}Co_{30}Ni_{15}Nb_2B_{19}Si_3$;

$Fe_{38}Co_{27}Ni_7Cr_6B_{19}Si_3$;

$Fe_{33}Co_{21}Ni_{17}Cr_6B_{20}Si_3$; and $Fe_{40}Co_{18}Ni_{14}Cr_6B_{19}Si_3$.

26. A magnetomechanical EAS marker according to claim 25, wherein 6.5 Oe≦Ha≦7.5 Oe.

27. A magnetomechanical EAS marker according to claim 24, wherein said active element has been annealed in the presence of a magnetic field directed transverse to a longitudinal axis of the active element to form a transverse anisotropy Ha in the active element such that 3 Oe≦Ha≦9 Oe.

28. A magnetomechanical electronic article surveillance marker comprising: a magnetostrictive element for use as an active element in said marker; said element being a strip of amorphous metal alloy, said element having been annealed so as to relieve stress in said element, said element having a magnetomechanical coupling factor k in a range of about 0.28 to 0.4 at a bias field level that corresponds to a minimum resonant frequency of said element, said alloy including iron, boron and no more than 40% cobalt.

29. A magnetomechanical electronic article surveillance marker according to claim 28, wherein said alloy includes at least one of chromium and niobium.

30. A magnetomechanical electronic article surveillance marker according to claim 29, wherein said alloy has a total combined proportion of chromium and/or niobium of from 2 to 8%.

31. A magnetomechanical electronic article surveillance marker according to claim 29, wherein said alloy includes nickel.

32. A magnetomechanical electronic article surveillance system comprising:

(a) generating means for generating an electromagnetic field alternating at a selected frequency in an interrogation zone, said generating means including an interrogation coil;

(b) a marker secured to an article appointed for passage through said interrogation zone, said marker including a strip of magnetostrictive amorphous metal alloy, said alloy strip having been annealed so as to relieve stress in said alloy strip, said alloy strip having a resonant frequency that varies according to a level of a bias magnetic field applied to said alloy strip, said alloy strip also having a bias-field-dependent resonant frequency characteristic such that the resonant frequency of said alloy strip varies by a total of no more than 800 Hz as the bias field applied to said alloy strip varies in the range of 4 Oe to 8 Oe; said marker also including means for applying a magnetic bias to said alloy strip so that said strip is magnetomechanically resonant when exposed to said alternating field at said selected frequency; and (c) detecting means for detecting said magnetomechanical resonance of said alloy strip.

33. A magnetomechanical electronic article surveillance system according to claim 32, wherein the bias-field-dependent resonant frequency characteristic of said alloy strip is such that the resonant frequency of said alloy strip varies by a total of no more than 200 Hz as the bias field applied to said element varies in the range of 4 to 8 Oe.

34. A magnetomechanical electronic article surveillance system according to claim 33, wherein the resonant frequency of said alloy strip shifts by at least 1.5 kHz when the bias field applied to said alloy strip is reduced to 2 Oe from a level in said range of 4 to 8 Oe.

35. A magnetomechanical electronic article surveillance system according to claim 32, wherein the resonant frequency of said alloy strip shifts by at least 1.5 kHz when the bias field applied to said alloy strip is reduced to 2 Oe from a level in said range of 4 to 8 Oe.

* * * * *

UNITED STATES PATENT AND TRADEMARK OFFICE

CERTIFICATE OF CORRECTION

PATENT NO. : 5,949,334

DATED : September 7, 1999

INVENTOR(S) : Ming-Ren Lian, et al.

It is certified that error appears in the above-identified patent and that said Letters Patent is hereby corrected as shown below:

Cover Page, item [75], line 3, delete "Fremont" and insert -- Delray Beach --.
Col. 1, line 9, delete "is" and insert -- issued --.
Col. 10, line 25, delete "Od;" and insert -- O≤d --.
Col. 12, line 62, delete "1.05" and insert -- 1.5 --.

Signed and Sealed this

Twenty-fourth Day of October, 2000

*Attest:*

Q. TODD DICKINSON

*Attesting Officer*

*Director of Patents and Trademarks*